US005634217A

United States Patent [19]

Silva

[11] Patent Number: 5,634,217

[45] Date of Patent: Jun. 3, 1997

[54] URINE DISPOSAL DEVICE

[76] Inventor: Robert Silva, 13492 Research Blvd. Ste 120-233, Austin, Tex. 78750

[21] Appl. No.: 434,066

[22] Filed: May 3, 1995

[51] Int. Cl.[6] ..... E03D 13/00

[52] U.S. Cl. ..... 4/302; 4/311; 4/321; 4/420

[58] Field of Search ..... 4/144.1, 262, 263, 4/266, 300.3, 301, 302, 310, 311, 321, 323, 431, 432, 433, 434, 435, DIG. 3, 313, 420, 436–440

[56] References Cited

U.S. PATENT DOCUMENTS

| | | | |
|---|---|---|---|
| 416,134 | 11/1889 | Weeden | 4/302 |
| 669,037 | 2/1901 | Stevens | 4/DIG. 3 |
| 1,204,705 | 11/1916 | Scott | 4/262 |
| 2,208,720 | 7/1940 | Coordes | 4/311 |
| 3,035,274 | 5/1962 | Baughman | 4/432 |
| 3,536,196 | 10/1970 | Zeff et al. | 4/323 X |
| 3,582,995 | 6/1971 | Enenstein | 4/321 X |
| 3,663,970 | 5/1972 | Drouhard et al. | 4/321 X |
| 3,931,650 | 1/1976 | Miller | 4/480 |
| 3,992,727 | 11/1976 | Elkins | 4/311 |
| 4,520,513 | 6/1985 | Raupuk, Jr. et al. | 4/313 X |
| 4,631,061 | 12/1986 | Martin | 604/318 |
| 4,713,847 | 12/1987 | Oldfelt et al. | 4/431 X |
| 4,734,943 | 4/1988 | Mellinger et al. | 4/323 X |
| 4,819,280 | 4/1989 | Rickard | 4/301 |
| 5,282,281 | 2/1994 | Clear et al. | 4/434 |

FOREIGN PATENT DOCUMENTS

| | | | |
|---|---|---|---|
| 2842322 | 4/1979 | Germany | 4/431 |
| 0496274 | 7/1954 | Italy | 4/263 |
| 0104828 | 4/1990 | Japan | 4/431 |
| 0397548 | 2/1966 | Switzerland | 4/301 |
| 1661023 | 7/1991 | U.S.S.R. | 4/321 |
| 2261611 | 5/1993 | United Kingdom | 4/301 |

*Primary Examiner*—Robert M. Fetsuga

*Attorney, Agent, or Firm*—Graves, Dougherty, Hearon & Moody

[57] ABSTRACT

A method an apparatus for disposing of urine is described comprising a funnel-like basin connected to a pump housing. The housing contains a fluid pump connected to the drain of the basin and activated by a fluid pressure sensor when the fluid pressure in the basin exceeds a predetermined value. The housing also contains means for connecting an external fresh water supply to the basin when the fluid pressure in the basin drops below a predetermined value.

3 Claims, 5 Drawing Sheets

URINE DISPOSAL DEVICE

BACKGROUND OF THE INVENTION

The present invention relates to the field of urine disposal devices. Incontinent persons, persons confined to wheelchairs, and similarly challenged persons face tremendous obstacles in trying to safely and efficiently dispose of urine. Typically, after such an individual urinates into a leg bag or similar container, the bag is either dumped directly onto the ground or disposed of by an attendant. In nursing homes and other care facilities, incontinent persons are often dependent upon an attendant to empty their leg bags and bed bags. Understandably, attendants in such facilities are frequently less than enthusiastic in disposing of urine. It is highly desirable to provide a system that decreases the amount of attendant care required by incontinent persons, eliminates the risk of contamination from AIDS or other communicable diseases to attendants working with said individuals, and to increase the level of independence for incontinent individuals that would otherwise require attendant care.

Prior art devices have not adequately addressed the above concerns. In Rickard, U.S. Pat. No. 4,819,280, a hand-held urinal and remote flush system comprising a portable bottle and a complementary water closet was disclosed. The Rickard invention does not eliminate the need for an attendant to transport the portable bottle to the complementary water closet. The present invention can be placed on the floor near the person's bed such that a leg bag or bed bag can be drained directly into the device which disposes of the urine without requiring further intervention. Miller, U.S. Pat. No. 3,931,650 discloses a disposal device for wheelchairs that permits persons confined to chairs to empty the contents of their leg bags into a drain located on the floor. Miller does not address the automatic disposal of the urine once it has been drained from the leg bag. Miller is seen as complementary to the present invention. By providing for a functional toilet only 4" in height, the present invention provides the ideal "floor drain" as described in Miller. Martin, U.S. Pat. No. 4,631,061 disclosed an automatic urine detecting, collecting and storing device. Martin is not addressed to the efficient disposal of the urine once it has been collected. In addition, by requiring incontinent persons to be attached to an large piece of machinery, Martin decreased, rather than increased, said persons independence. By also describing a system containing liquid sensors driven by an electrical circuit in close proximity to the person's urethra, Martin had considerable safety concerns. Elkins, U.S. Pat. No. 3,992,727, disclosed a portable toilet that is only tangentially related to the present invention in that Elkins is not designed for use by bed-ridden or chair-confined persons.

The present invention provides a method that enables any person unable to use a conventional toilet or urinal to safely and efficiently dispose of urine. The system comprises a shallow, funnel-like basin which contains a fresh water reservoir. The lower end of the basin funnels into a housing for a submerged electro-mechanical fluid pump. The pump is automatically activated by a sensor. When urine is drained from a leg bag or bed bag into the fresh water reservoir of the device, the sensor senses the addition of fluid to the reservoir. The sensor activates the pump which starts pumping fluids into an external sewer or septic system. The device then allows clean water to flow into itself, which washes the basin and replenishes fresh water in the reservoir. Preferably the device will have a self-contained safety sensor capable of overriding the water input into the reservoir.

SUMMARY OF THE INVENTION

It is an object of this invention to provide an efficient urine disposal device.

It is a further object of this invention to provide a device that automatically disposes of urine upon sensing the addition of urine to the system.

It is a further object of this invention to provide a device that substantially decreases the need for attendant intervention in the disposal of urine from a leg bag or a bed bag.

It is a further object of this invention to provide a device that substantially decreases an attendant's exposure to the urine of bed-ridden and chair-confined persons.

It is a further object of this invention to provide a low lying functional urine disposal system such that a standard wheelchair can move over the invention for automatic disposal of urine from the leg bag of a wheelchair-confined person.

It is a further object of this invention to provide a urine disposal device that cleans itself each time it disposes of urine.

It is a further object of this invention to provide a compact and inconspicuous urine disposal device.

Other objects and features of the present invention will become apparent from the following detailed description considered in connection with the accompanying drawings.

DETAILED DESCRIPTION OF THE PREFERRED EMBODIMENT

Figure 1:
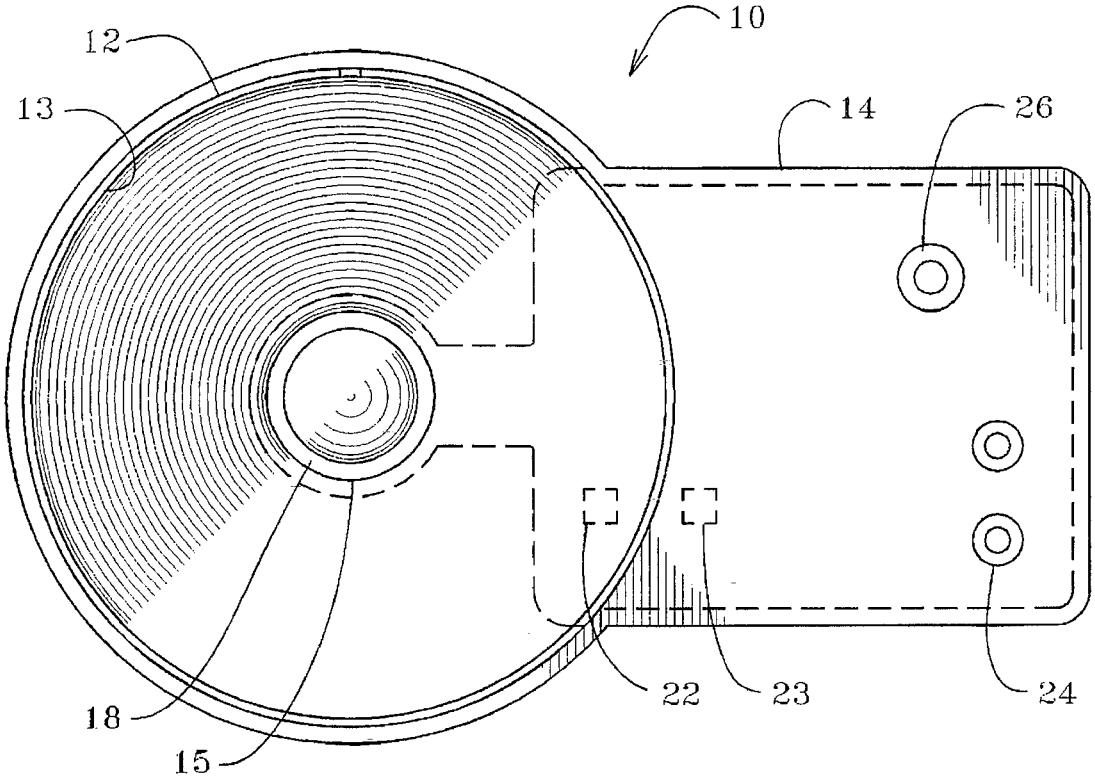
FIG. 1 is a top view of the present invention.
Figure 3:
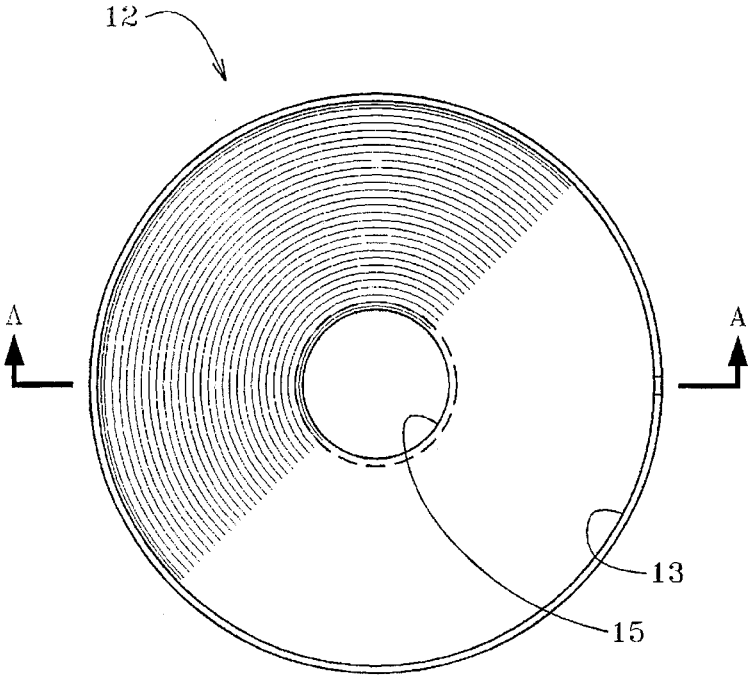
FIG. 3 is a detailed perspective of the funnel-like basin.
Figure 8:
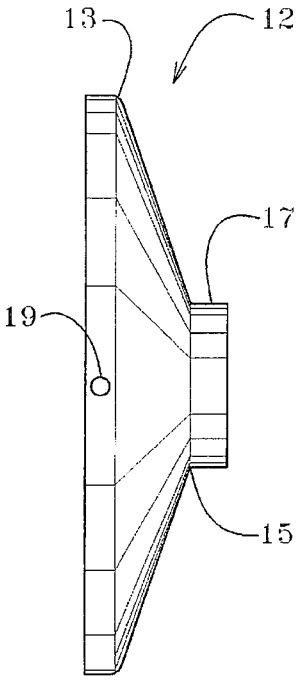
FIG. 8 is a detailed cross-section of one embodiment of the funnel-like basin.
Figure 7:
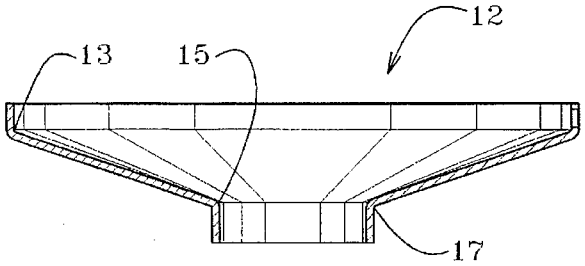
FIG. 7 is a cross-section of the funnel-like basin.
Figure 4:
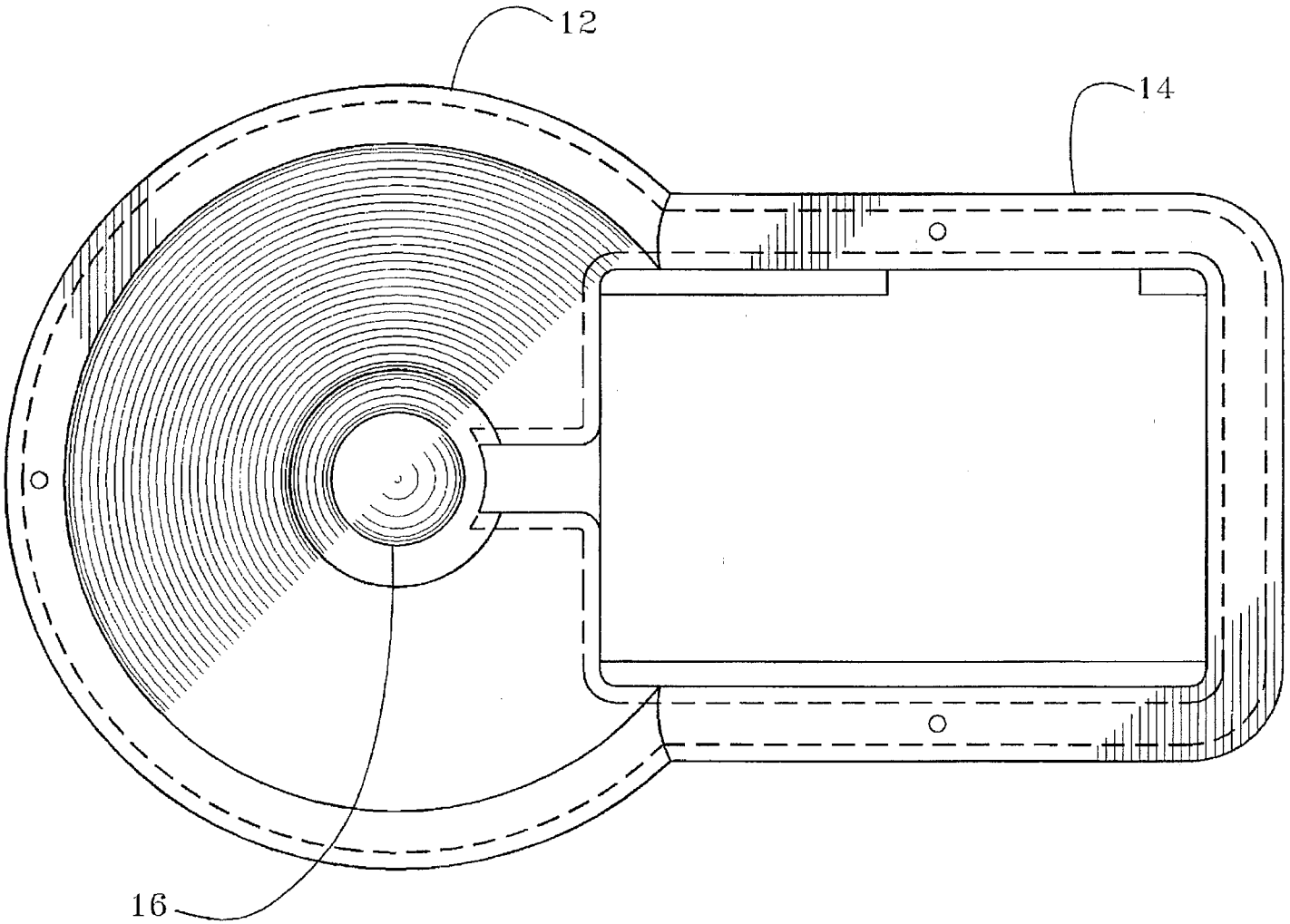
FIG. 4 is a detailed top view perspective of the present invention.
Figure 5:
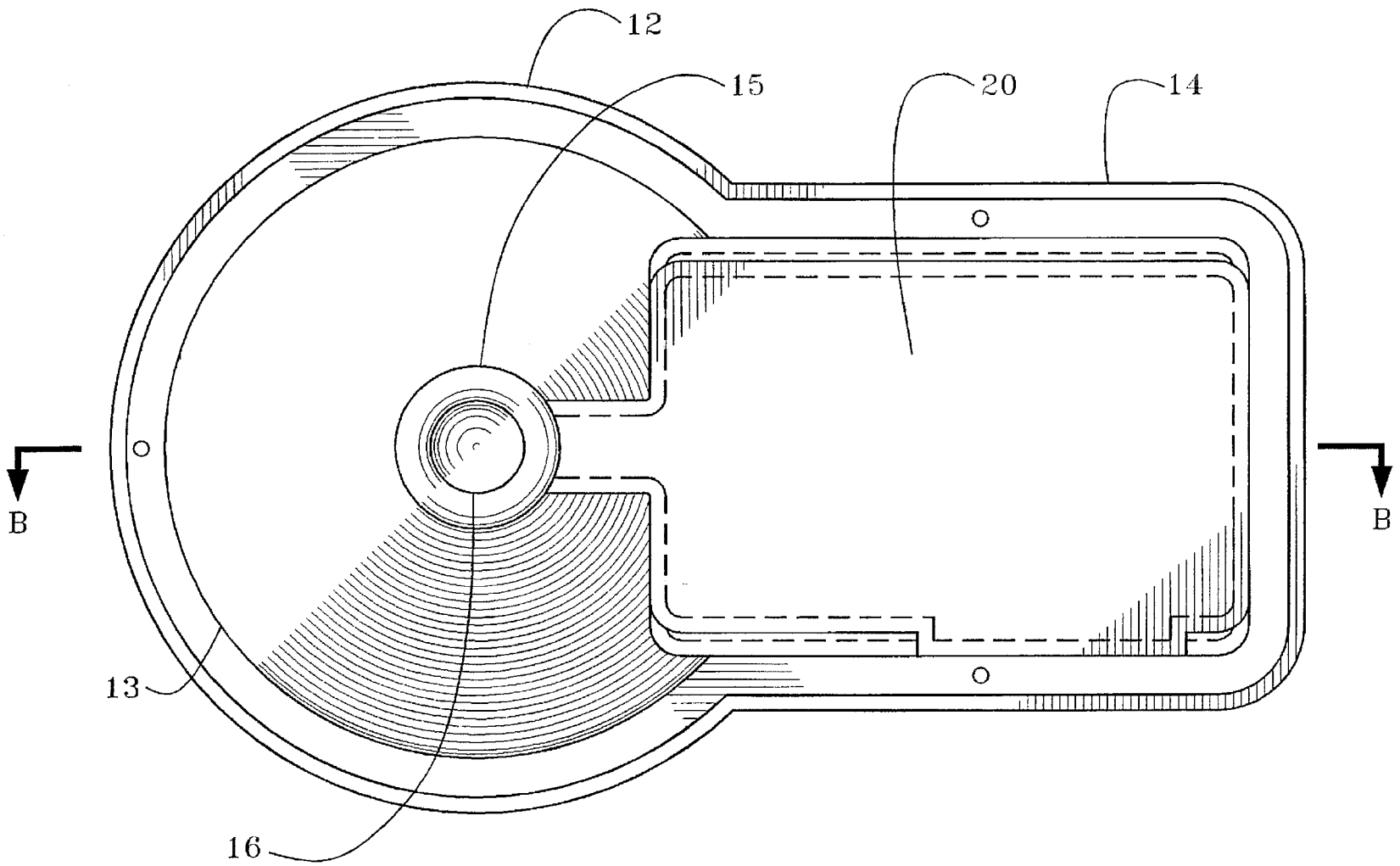
FIG. 5 is an alternative view of the present invention.

Referring to FIG. 1, the device 10 comprises a circular funnel like basin 12 having an upper and wider diameter 13 and a lower and narrower diameter 15. A detailed of the basin is shown in FIGS. 3, 7, and 8. A drain 17 extends from the lower diameter 15. The basin 12 is integrally connected to the pump housing 14 such that liquid flowing out of drain 17 flows into pump housing 14. A cylindrical or spherical island 16 of slightly less diameter than the narrower diameter 15 can be molded into the housing 14 such that the island 16 extends up through drain 17 so that items accidentally dropped into the device 10 do not cause malfunctions. The island 16 is situated in a reservoir of fresh water 18. In the preferred embodiment, the pump housing 14 contains an electro-mechanical fluid pump 20, a electro-mechanical fluid pressure sensor 22, an inlet valve 24, and a discharge valve 26. As an alternative to the electro-mechanical fluid pressure sensor 22, other sensors, such as a timer, a float switch, a reed switch, a mercury switch, or a number of other types of sensors can be used to activate the pump. In the preferred embodiment, inlet valve 24 is connected to an external fresh water source and is normally closed. Discharge valve 26 is connected to a sewage line or septic system and has a check valve for preventing back flow from the septic system.

Figure 2:
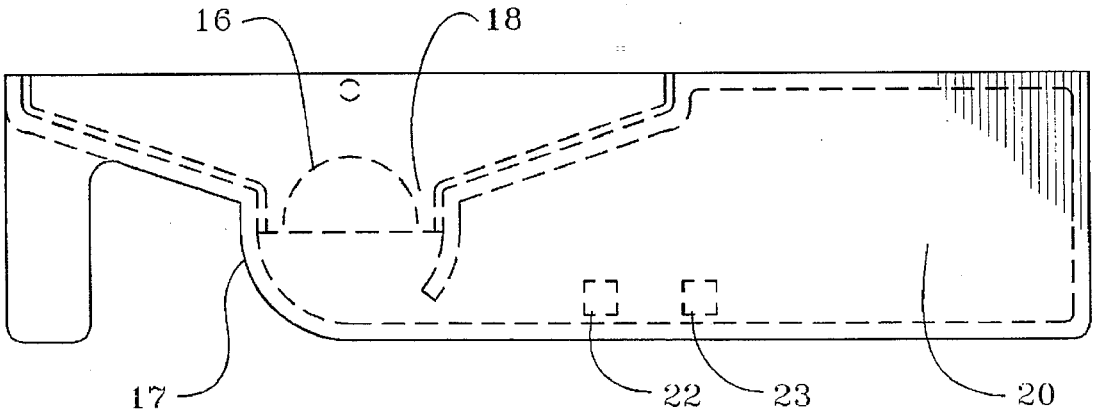
FIG. 2 is a side vide of the present invention
Figure 6:
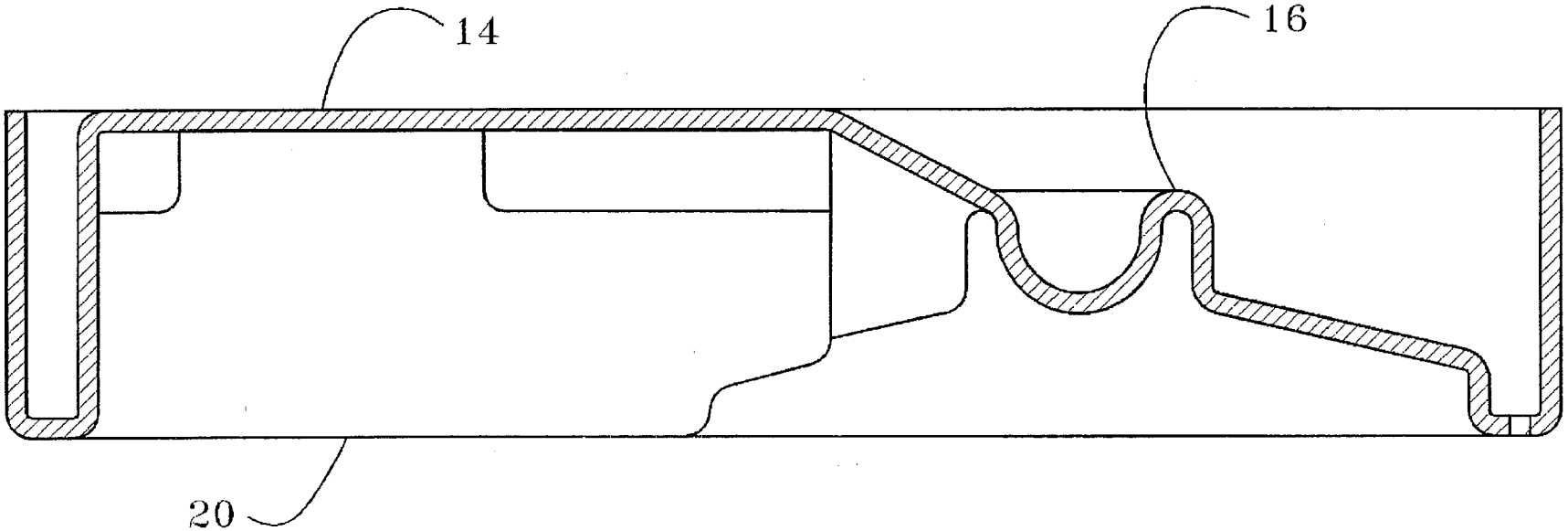
FIG. 6 is a cross-section of the pump housing.

Fluid pump 20, shown in FIG. 2 and FIG. 6 is a commercially available submersible fluid pump common in the art of fountain pumps. Information about such a pump can be obtained from Beckett Corporation at 2521 Willowbrook Road, Dallas Tex. 75220-6421. Inlet valve 24, shown in FIG. 1 is a commercially available electro-mechanical solenoid valve commonly found in ice-makers, dishwashers, and other automatic water feed devices that, when open, permits fresh water to flow into the basin 12 cleansing the basin 12 and replenishing the reservoir. Discharge valve 26 is a check valve that prevents back flow from the externally connected disposal line. Device 10 is powered with standard 120V AC power from any wall socket.

As an added safety precaution, an additional fluid pressure sensor 23 may be used. In systems employing two sensors, sensor 22 detects high pressure and activates fluid pump 20 while sensor 23 detects low pressure and activates inlet valve 24. By incorporating independent means for activating the fresh water input and the waste/discharge, the device 10 is prevented from adding additional fresh water to a flooded system that might occur if the pump became occluded for any reason.

In its static state, device 10 has a fresh water reservoir 18 in basin 12. As urine is drained into the system 10, pressure sensor 22 detects the additional fluid pressure and activates fluid pump 20 which starts pumping the urine/fresh water mixture through discharge valve 26 into an external sewer or septic system. As pump 20 discharges fluids, the fluid pressure decreases. When pressure sensor 23 detects pressure below a threshold value, inlet valve 24 is opened and fresh water flows from an external fresh water line through inlet valve 24 and into basin 12 at opening 19 located proximal to the upper and wider diameter 15.

I claim:

1. A urine disposal device comprising:

a funnel-like basin adapted to hold a fluid reservoir, said basin having an upper and a lower section, said lower section having a diameter that is smaller than a diameter of said upper section, said upper section having an opening;

a drain extending from said lower section;

a pump housing connected to said drain;

an electro-mechanical fluid pump located within said housing;

an inlet valve connected to said basin at the opening and adapted for connection to a fresh water supply;

first and second sensors located within said housing, said first sensor operationally controlling said pump and said second sensor operationally controlling said inlet valve.

2. The device according to claim 1 wherein said first and second sensors are electro-mechanical fluid pressure sensors.

3. A urine disposal device comprising:

a funnel-like basin adapted to contain a fluid reservoir, said basin having an upper section with a first diameter, a lower section connected to said upper section, said lower section having a second diameter less than said first diameter of said upper section, said upper section having an opening;

an inlet valve having an open and a closed position, said valve being connected to the basin at the opening in said basin and being adapted for connection to an external water supply;

a pump housing connected to said basin;

a drain extending downwardly from said lower section of said basin into said pump housing;

an electro-mechanical fluid pump located within said housing;

a discharge valve connected to said pump and adapted to connect to an external waste area; and first and second fluid pressure sensors, said first fluid pressure sensor initiating the operation of said pump when said first fluid pressure sensor detects a fluid level within said housing that exceeds a first predetermined level, and said second fluid pressure sensor opening said inlet valve when said second fluid pressure sensor detects a fluid level within said housing below a predetermined level.

* * * * *